United States Patent [19]

Gore

[11] Patent Number: 4,497,509

[45] Date of Patent: Feb. 5, 1985

[54] CONTINUOUS BUSINESS FORM FOR AUTOMATED MAILING

[75] Inventor: Thomas C. Gore, Crystal Lake, Ill.

[73] Assignee: Uarco Incorporated, Barrington, Ill.

[21] Appl. No.: 419,547

[22] Filed: Sep. 16, 1982

[51] Int. Cl.[3] ..... B41L 1/26

[52] U.S. Cl. ..... 282/11.5 A; 229/69; 281/2

[58] Field of Search ..... 229/69, 71, 73; 281/2, 281/5, 1 R, 1 A, 66 R; 282/11.5 R, 11.5 A, 25 R, 27 R

[56] References Cited

U.S. PATENT DOCUMENTS

| | | | |
|---|---|---|---|
| 2,790,593 | 4/1957 | Reuter | 229/69 |
| 2,824,686 | 2/1958 | Hamilton | 229/69 |
| 3,104,799 | 9/1963 | Steidinger | 229/69 |
| 3,253,545 | 5/1966 | Carleton | 282/25 X |
| 3,306,632 | 2/1967 | Stahmer | 282/25 |
| 3,343,851 | 9/1967 | Bensler, Sr. et al. | 281/5 |
| 3,674,286 | 7/1972 | Dodgson | 283/66 A X |
| 4,091,987 | 5/1978 | Cone | 282/11.5 A X |
| 4,159,129 | 6/1979 | Lockhart | 282/27 R |

FOREIGN PATENT DOCUMENTS

| | | | |
|---|---|---|---|
| 1231479 | 9/1960 | France | 229/69 |
| 1244834 | 9/1960 | France | 282/11.5 A |

*Primary Examiner*—Paul A. Bell

*Attorney, Agent, or Firm*—Wood, Dalton, Phillips, Mason & Rowe

[57] ABSTRACT

A continuous business form for use in automated mailing systems including a single elongated ply having control punch margins on its longitudinal edges. Longitudinal lines of weakening are disposed inwardly of the control punch margins to define removable feed strips and a main panel. The main panel is divided by a plurality of cross lines of weakening into a mailing facilitating panel and a message bearing panel such that the mailing facilitating panel has a length that is a minor fraction of the length of the message bearing panel. Mailing facilitating devices, such as an envelope, a label, or a stencil, are carried by the mailing facilitating panel.

10 Claims, 4 Drawing Figures

CONTINUOUS BUSINESS FORM FOR AUTOMATED MAILING

FIELD OF THE INVENTION

This invention relates to continuous business forms, and more specifically, to continuous business forms for use in automated mailing systems.

BACKGROUND ART

Mass mailings to potential customers or the like have become increasingly popular and many systems have evolved to facilitate automation of the mailing process. In some systems, there are provided continuous envelope assemblies which may be addressed in a computer printer and subsequently stuffed with literature or the like. Other systems involve the use of stuffed sealed envelope assemblies wherein variable information is printed on the interior material through a part of the envelope utilizing selected locations of image transfer materials such as carbon.

Still others utilize carrier strips. For example, in one such prior art system, an elongated, continuous strip of paper provided with control punch margins carries, in alternating fashion, envelopes and letterheads which are removably glued to the carrier. The strip, with the envelopes and letterheads attached is fed through a computer printer or the like during which time the envelope is addressed and the letterhead printed with the desired information to be conveyed to the recipient. After printing, the envelope and the adjacent letterhead are removed from the carrier strip and the letterhead stuffed in the envelope and placed in the mail. The carrier strip is ultimately destroyed.

Still another system utilizes envelopes which are removably disposed on a carrier strip which are then addressed while being fed through a continuous printer or the like. The envelopes are then removed and filled with suitable material intended for the recipient. Part of the carrier strip is such that after the envelope is removed, it can be printed upon for whatever purpose desired. Such a construction is shown in U.S. Pat. No. 2,824,686 issued Feb. 25, 1958 to Hamilton.

Each of the foregoing systems has its advantages and disadvantages. For example, with continuous envelope assemblies, because the same are not necessarily processed side by side with the insert material, it is possible that the wrong message may be put in an envelope.

In the case of stuffed sealed envelope assemblies, this difficulty is avoided but it is quite apparent to the recipient that he is not receiving a personal communication in the sense of a personal letter or the like.

In the case of carrier mounted envelopes and letterheads, the foregoing difficulties are avoided but in view of the disposal of the carrier strip, the system is more expensive than is desired.

In the case of the Hamilton construction, before the carrier strip may be used for printing, it is necessary that the envelope be removed. Thus, it is not practical to print a message on the carrier strip after removal of the envelope with any assurance that such message will be stuffed in the proper envelope. In other words, Hamilton suffers the same deficiencies as continuous envelope structures.

The present invention is directed to overcoming one or more of the above problems.

SUMMARY OF THE INVENTION

It is the principal object of the invention to provide a new and improved continuous business form for use in automated mailing systems which avoids the problems of wrong messages being stuffed into envelopes, provides the capability of sending a highly personalized mailing piece to a recipient and which minimizes waste of materials.

An exemplary embodiment of the invention achieves the foregoing object in a business form including a single elongated ply of paper having feeding means on at least one longitudinal edge. A longitudinal line of weakening is adjacent the edge but spaced therefrom sufficiently to accomodate the associated one of the feeding means to define a removable feed strip and a main panel. A plurality of cross lines of weakening extend across the ply to divide the main panel into alternating mailing facilitating panels and message bearing panels with the mailing facilitating panels having a length longitudinally of the ply which is a minor fraction of the length of each message bearing panel. Means are secured to the mailing facilitating panels and cooperate therewith to define mailing pieces for the message bearing panels.

According to one form of the invention, the mailing facilitating means includes an envelope. According to another embodiment of the invention, the mailing facilitating means includes a label, while according to still a third embodiment of the invention, the mailing facilitating means includes a stencil.

In a highly preferred form of the invention, the message bearing panel is a letterhead.

When the continuous business form is intended to be used to provide a highly personalized appearing mailing, the lines of weakening are defined by perforations having alternating slits and ties, the ties being of sufficiently short length as to cause the message bearing panel, when separated from the form, to have the visual appearance of a cut sheet.

Other objects and advantages will become apparent from the following specification taken in connection with the accompanying drawings.

BEST MODE FOR CARRYING OUT THE INVENTION

Figure 1:
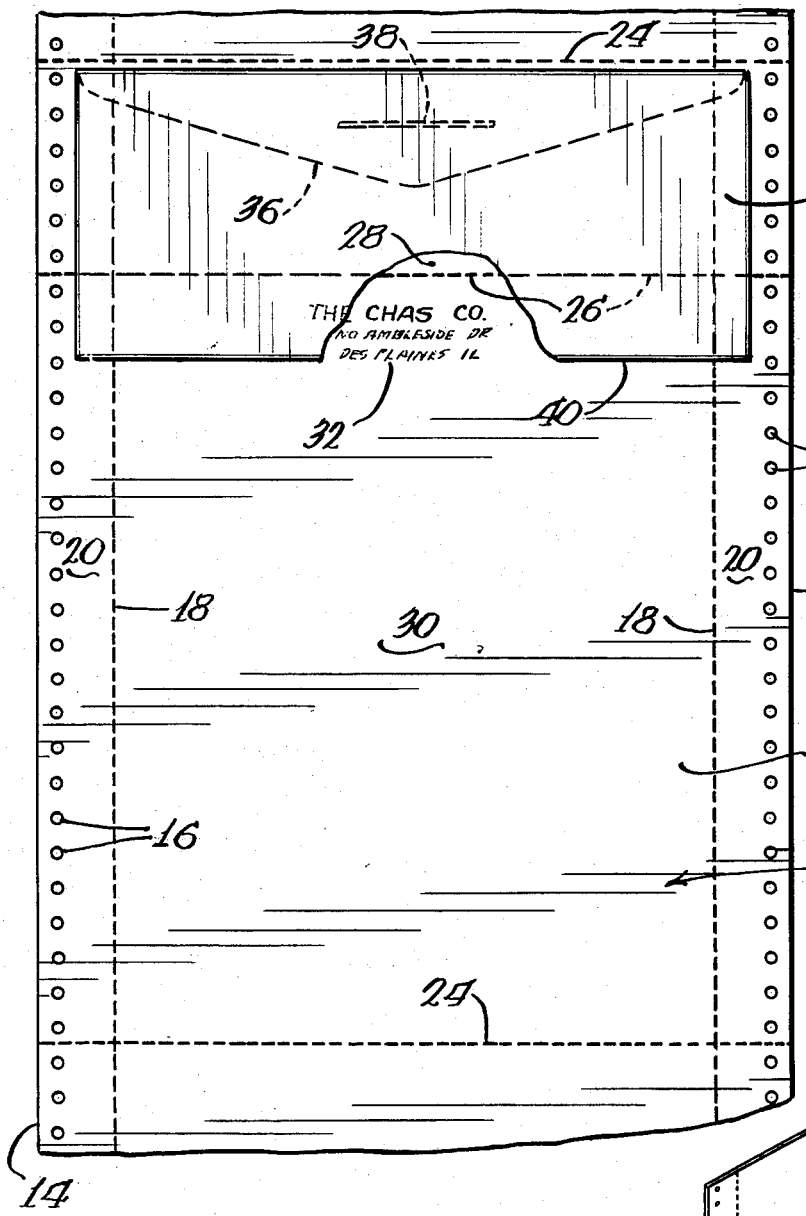
FIG. 1 is a plan view of a continuous business form made according to the invention.

An exemplary embodiment of a continuous business form made according to the invention for use in automated mailing systems is illustrated in FIG. 1 and is seen to comprise a single, elongated ply of paper 10. Closely adjacent the longitudinal edges 12 and 14 of the ply 10 are a series of punched holes 16 defining control punch margins as is well known.

Also adjacent the longitudinal edges 12 and 14, but inwardly of the control punch margins 16, are longitudinal lines of weakening 18. The lines of weakening 18 define removable feeding strips 20 adjacent the longitudinal edges 12 and 14 of the ply 10. The area of the ply 10 between the lines of weakening 18 defines a main panel, generally designated 22.

Extending transversely of the ply 10 and across the same are cross lines of weakening 24 and 26. As seen in FIG. 1, from top to bottom, a cross line of weakening 24 is relatively closely followed by a cross line of weakening 26 to define, as part of the main panel 20, a mailing facilitating panel 28. Continuing from the line of weakening 26 downwardly toward the next line of weakening 24, the two define a message bearing panel 30. When the continuous business form is to be employed in an automated mailing system which is intended to provide a highly personalized mailing, the message bearing panel 30, at its upper edge, is provided with indicia 32 in the form of a conventional letterhead.

It will be observed that the size of the message bearing panel 30 is considerably greater than the size of the mailing facilitating panel 28. Stated another way, the length of the mailing facilitating panel 28 longitudinally of the form is but a minor fraction of the length of the message bearing panel 30 measured longitudinally of the form.

In the usual case, the lines of weakening 18, 24 and 26 are typically disposed such that the message bearing panel 30 will have a dimension of $8\frac{1}{2}\times 11$ inches, that is, conventional letterhead size. The mailing facilitating panel 28 will, of course, have a width of $8\frac{1}{2}$ inches when used in such a system but the length thereof, for an embodiment such as shown in FIG. 1, will typically be about 3 inches.

In the embodiment illustrated in FIG. 1, the mailing facilitating panel 28 carries a conventional folded envelope 34 having a folded flap 36 shown in the closed position but not as yet sealed to the remainder of the envelope. An easily releasable glue 38 adheres the envelope flap 36 to the mailing facilitating panel 28.

Typically, the envelope 34 will be a standard size business envelope and as such will be bigger than the mailing facilitating panel 28. Thus, the lower edge 40 of the envelope extends downwardly as shown in FIG. 1 to the point where it overlaps the upper edge of the message bearing panel 30, and specifically, the indicia 32. This is not objectionable, and in fact desirable, for the following reasons. In use, the mailing facilitating panel 28 is discarded after the envelope 34 is separated thereform and thus is wasted. Consequently, the smaller the panel 28 may be made, the less wastage is involved. Since printing on a letterhead as by a typewriter, computer printer or the like, will never occur at or above the letterhead indicia 32, the construction illustrated in FIG. 1 minimizes wastage and yet assures that the envelope 34 is placed so that the message receiving portion of the panel 30 is exposed and printed upon as the form is processed by a computer printer.

In a highly preferred embodiment, the lines of weakening, 18, 24 and 26 are extremely fine perforations such that when the panel 28 is removed from the message bearing panel 30 along with the feeding strips 20, the panel 30 will have edges that appear as would the edges of a conventional cut sheet letterhead. To this end, the lines of weakening 18, 24 and 26 are formed by perforations defined by alternating slits and ties. The ties are sufficiently fine, that is, have sufficiently short length, that when the line of weakening is broken, the characteristic ragged edge of conventional perforations will not be apparent.

Perforations of the preferred sort are disclosed in the commonly assigned, co-pending application of David H. Schnitzer, Ser. No. 302,571 filed Sept. 15, 1981, entitled "Fine Tooth Perforation of Webs", and the disclosure of the same is herein incorporated by reference. For present purposes, it is sufficient to state that the ties between slits forming the perforations defining the lines of weakening have lengths no more than about 0.010 inches and are sufficient in number to provide a burst strength in the range of about 8–20 pounds per two lineal inches of length of the associated line of weakening.

Figure 2:
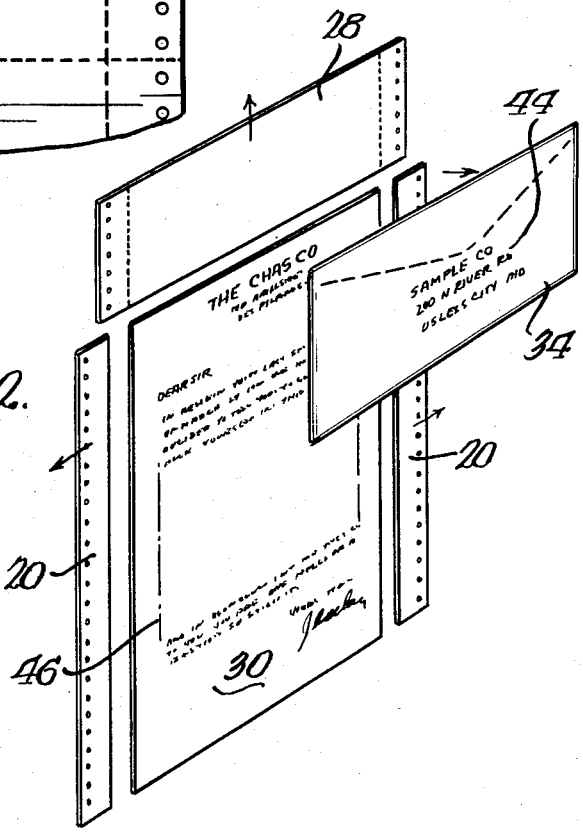
FIG. 2 is a perspective view of one form length of the business form with the parts thereof separated from one another.

As seen in FIG. 2, and as alluded to previously, the form is processed through a computer printer such that an address 44 is placed on the front of the envelope 34. The envelope is then removed from the mailing facilitating panel 28 which in turn is separated, along with the feed strips 20, from the message bearing panel 30 which has already received a message 46 during passage through the computer printer immediately following the printing of the address 44 on the envelope 34. Thus, the addressed envelope 34 and the printed message bearing panel 30 always stay together allowing stuffing of the message bearing panel 30 into the envelope 34 immediately upon separation of the components as illustrated in FIG. 2. Thus, the system avoids stuffing errors common in other automated envelope systems.

Figure 3:
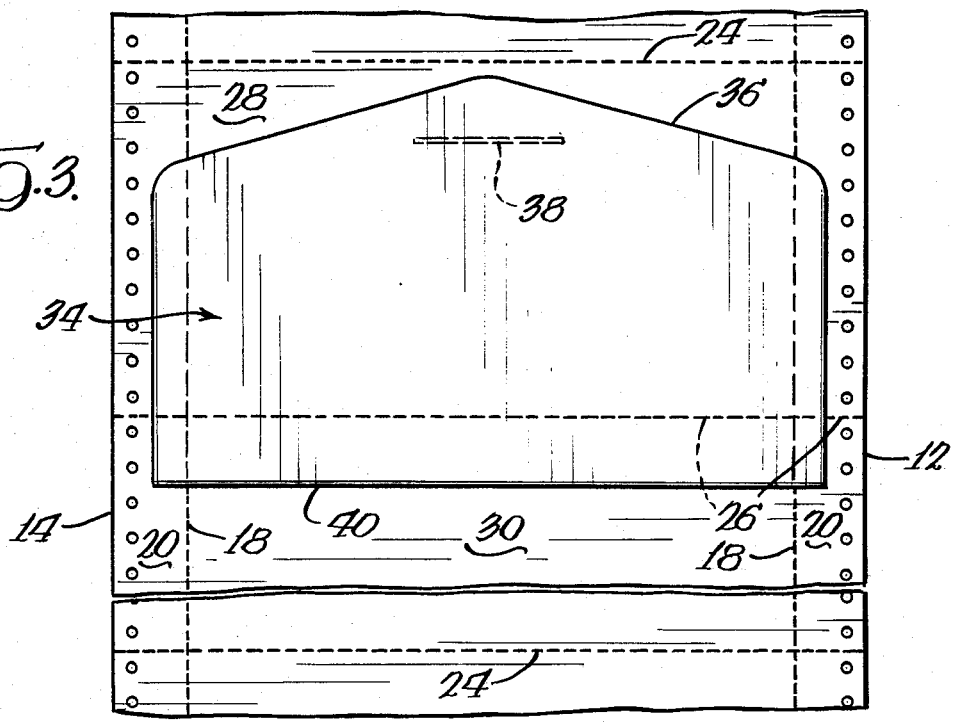
FIG. 3 shows a modified embodiment of the invention.

FIG. 3 illustrates a modified embodiment of the invention which is in all respects, save one, the same as that previously described. Specifically, in the FIG. 3 embodiment, the envelope flap 36 is in an open position when removably glued to the mailing facilitating panel 28. Frequently, but not always, the embodiment of FIG. 3 may require the increasing of the length of the mailing facilitating panel 28 to assure that the lower edge 40 of the envelope 34 does not extend past letterhead indicia and thereby obstruct and prevent printing on the upper part of the message bearing panel 30. In some instances, the embodiment of FIG. 3, though it may result in slightly more wastage than the embodiment of FIG. 1, is preferred in terms of ability to feed the assembly through a computer printer.

Figure 4:
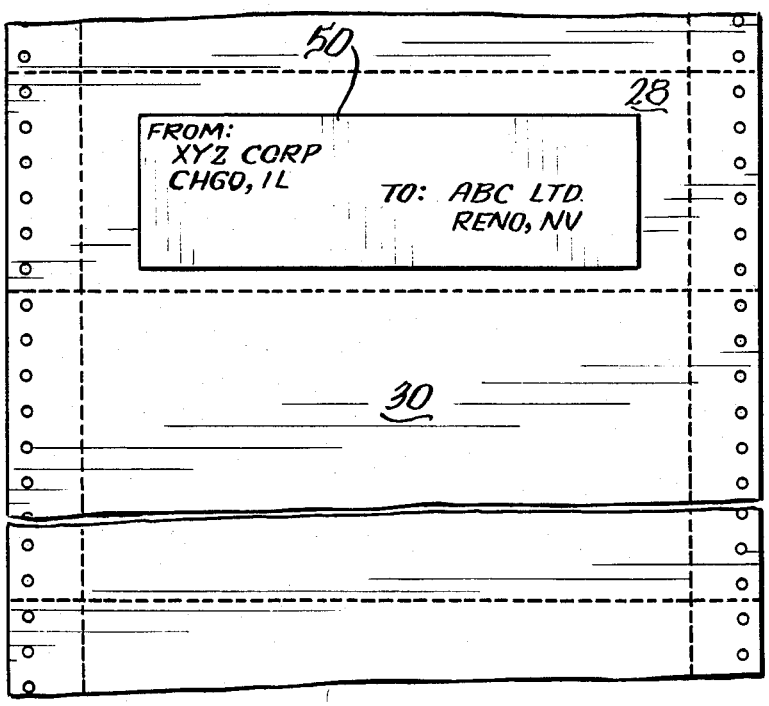
FIG. 4 illustrates still a further modified embodiment of the invention.

Still a further embodiment is illustrated in FIG. 4 and the same may be utilized in application where it is not necessary to employ an envelope as part of the mailing piece. In the embodiment of FIG. 4, a card 50 is removably secured to the mailing facilitating panel 28 in lieu of an envelope. The card 50 may be simply in the form of a gummed label which is printed upon by the computer printer and then removed from the panel 28 to be placed on a large mailing envelope, package or the like. Alternately, where a number of items must be mailed or shipped to a single location and yet there is a need for but a single message, the card 50 may be a stencil. In such a case, the stencil comprising the card 50 is cut in the computer printer at the same time the message bearing panel 30 is completed. The card 50 is then removed from the message bearing panel 28 and, in the usual fashion, the address information contained on the stencil may be applied to several packages going to a common address. This use of the system is particularly adapted for invoicing and shipping requirements as opposed to mass mailings.

Though not shown herein, it will be appreciated that other mailing facilitating devices may be associated with the mailing facility panel 28 as desired.

From the foregoing, it will be appreciated that a continuous business form made according to the invention avoids the problems of prior art structures. For one, stuffing errors are minimized since, at all times, the addressed envelope and the printed message are kept in adjacency to each other and are processed virtually simultaneously.

At the same time, the wastage heretofore associated with the use of carrier type products is vastly reduced since the carrier and the letterhead are the same piece of paper. Finally, utilizing that embodiment of the invention employing fine perforations as the lines of weakening, the message bearing panel 30, when separated from the remainder of the components, has edge appearance to the recipient equivalent to that of a cut sheet letterhead thereby providing a highly personalized mailing.

I claim:

1. A continuous business form for use in automated mailing systems or the like, comprising:

a single elongated ply of paper having feeding means on at least one longitudinal edge;

a longitudinal line of weakening adjacent said edge(s) but spaced therefrom sufficiently to accomodate the associated one of said feeding means to define a removable feed strip and a main panel;

a plurality of cross lines of weakening extending across said ply to divide said main pane into alternating mailing facilitating panels and message bearing panels, with each said mailing facilitating panel having a length longitudinally of the ply that is a minor fraction of the length of each message bearing panel longitudinally of the web; and means secured to said mailing facilitating panels and cooperating therewith without substantially obstructing said message bearing panels to define mailing pieces for said message bearing panels.

2. A continuous business form for use in automated mailing systems or the like, comprising:

an elongated ply of paper having feeding means on at least one longitudinal edge;

a longitudinal line of weakening adjacent said edge(s) but spaced therefrom sufficiently to accomodate the associated one of said feeding means to define a removable feed strip and a main panel;

a plurality of cross lines of weakening extending across said ply to divide said main panel into alternating mailing facilitating panels and message bearing panels, with each said mailing facilitating panel having a length longitudinally of the ply that is a minor fraction of the length of each message bearing panel longitudinally of the web; and mailing facilitating means removably secured to said mailing facilitating panels;

said business form being characterized by the absence of a carrier web and further characterized by the majority of said message bearing panel being exposed for the printing of message indicia thereon.

3. The continuous business form of claim 2 wherein said lines of weakening are defined by perforations having alternating slits and ties of sufficiently short length as to cause said message bearing panel to have the visual appearance of a cut sheet.

4. A continuous business form for use in automated mailing systems or the like, comprising:

a single elongated ply of paper having feeding means on at least one longitudinal edge;

a longitudinal line of weakening adjacent said edge(s) but spaced therefrom sufficiently to accomodate the associated one of said feeding means to define a removable feed strip and a main panel;

a plurality of cross lines of weakening extending across said ply to divide said main panel into alternating mailing facilitating panels and message bearing panels, with each said mailing facilitating panel having a length longitudinally of the ply that is a minor fraction of the length of each message bearing panel longitudinally of the web; and mailing facilitating means removably secured to said mailing facilitating panels in substantial non-obstructing relation to said message bearing panels;

said lines of weakening being defined by alternating slits and ties wherein the ties have lengths no more than about 0.010 inches and are sufficient in number to provide a burst strength in the range of about 8–20 pounds per two lineal inches of length of the line of weakening.

5. A continuous business form for use in automated mailing systems or the like, comprising:

a single elongated ply of paper having feeding means on at least one longitudinal edge;

a longitudinal line of weakening adjacent said edge(s) but spaced therefrom sufficiently to accomodate the associated one of said feeding means to define a removable feed strip and a main panel;

a plurality of cross lines of weakening extending across said ply to divide said main panel into alternating mailing facilitating panels and message bearing panels, with each said mailing facilitating panel having a length longitudinally of the ply that is a minor fraction of the length of each message bearing panel longitudinally of the web; and mailing facilitating means removably secured to said mailing facilitating panels in substantial non-obstructing relation to said message bearing panels so that said message bearing panels may be inscribed while attached to an adjacent mailing facilitating panel with said mailing facilitating means still secured thereto.

6. The continuous business form of claim 5 wherein said mailing facilitating means includes an envelope.

7. The continuous business form of claim 5 wherein said mailing facilitating means includes a label.

8. The continuous business form of claim 5 wherein said mailing facilitating means includes a stencil.

9. The continuous business form of claim 5 wherein said mailing facilitating means is an envelope and said message bearing panel contains letterhead indicia.

10. The continuous business form of claim 9 wherein said envelope at least partially overlaps said letterhead indicia.

* * * * *